US006866184B2

(12) United States Patent
Wood

(10) Patent No.: US 6,866,184 B2
(45) Date of Patent: Mar. 15, 2005

(54) MAIL CONTAINER WITH CONTAMINANT INDICATOR

(76) Inventor: James T. Wood, 527 Eddie Robinson Sr Dr., Baton Rouge, LA (US) 70802

( * ) Notice: Subject to any disclaimer, the term of this patent is extended or adjusted under 35 U.S.C. 154(b) by 0 days.

(21) Appl. No.: 10/044,755

(22) Filed: Oct. 23, 2001

(65) Prior Publication Data

US 2003/0075593 A1 Apr. 24, 2003

(51) Int. Cl.[7] ..... B65D 27/04
(52) U.S. Cl. ..... 229/71
(58) Field of Search ..... 229/71, 83

(56) References Cited

U.S. PATENT DOCUMENTS

| | | | | | |
|---|---|---|---|---|---|
| 30,980 | A | * | 12/1860 | Murray | 229/71 |
| 705,470 | A | * | 7/1902 | Starmer | 229/83 |
| 1,041,827 | A | * | 10/1912 | MacNaughton | 229/71 |
| 1,201,519 | A | * | 10/1916 | Sorensen | 229/80 |
| 1,264,451 | A | * | 4/1918 | Swift | 229/71 |
| 1,387,717 | A | * | 8/1921 | Hogan | 229/71 |
| 4,597,591 | A | * | 7/1986 | Gendron et al. | 283/116 |
| 4,711,347 | A | * | 12/1987 | Drexler et al. | 206/38 |
| 4,729,506 | A | * | 3/1988 | Neubauer | 229/69 |
| 5,894,986 | A | * | 4/1999 | Lederman et al. | 229/71 |
| 6,029,883 | A | * | 2/2000 | Hechinger et al. | 229/71 |

FOREIGN PATENT DOCUMENTS

| | | | | |
|---|---|---|---|---|
| GB | 20342 | * | 11/1891 | 229/71 |

* cited by examiner

*Primary Examiner*—Jes F. Pascua
(74) *Attorney, Agent, or Firm*—Roy, Kiesel, Keegan & DeNicola

(57) ABSTRACT

A mail container with a contaminant indicator mechanism in the form of a perimeter edge viewing window is provided for verifying that a mail item received does not contain a biological hazard in the form of a loose particulate such as powders, granules, and the like. In order to attract the attention of the mail recipient that particulate matter may be contained in a mail container, an area having a quantity of clear, adhesive on only a portion of one or more of the transparent perimeter edge viewing windows so that the mail recipient or delivery person could immediately identify the existence of particulate matter contamination.

4 Claims, 4 Drawing Sheets

MAIL CONTAINER WITH CONTAMINANT INDICATOR

TECHNICAL FIELD

The present invention relates to mail containers such as envelopes, mailing tubes, boxes, etc, and more particularly to a mail container with contaminant indicator that includes a transparent window provided along a perimeter edge of the mailing container for allowing a mail recipient to verify that the mail container is free from particulate contaminates such as powders, granules, particles, etc.

BACKGROUND ART

The threat of receiving biologically contaminated mail has increased due to the increasing use of terrorist tactics by groups and individuals seeking to further their political agendas. Because virtually everyone who receives mail is subject to such threats, it would be a benefit, particularly to advertisers and companies seeking to send legitimate correspondence, packages and the like to have a mail container with a contaminant indicator that could be used by legitimate individuals and companies which would provide the recipient of mail items with a mechanism for verifying the mail item received does not contain a biological hazard in the form of a loose particulate such as powders, granules, and the like. As used herein the term "mail" is used to encompass items delivered by the United States Postal Service as well as other well known express shipping companies that deliver overnight letters, parcels, and other packages. In order to attract the attention of the mail recipient that particulate matter may be contained in a mail container, it would be a further benefit to have a mail container that included a quantity of clear, adhesive on only a portion of one or more of the transparent perimeter edge viewing windows so that the mail recipient or delivery person could immediately identify the existence of particulate matter contamination. Because persons unfamiliar with the mail container of the invention might not understand its operation, it would be a still further benefit if a quantity of clear, adhesive was deposited on only a portion of a number of in-line transparent perimeter edge viewing windows wherein each window had adhesive shaped in the shape of a letter such that should particulate contaminates become attached to the adhesive, a warning message, such as the word "DANGER" would be visible along a perimeter edge of the mail container.

GENERAL SUMMARY DISCUSSION OF INVENTION

It is thus an object of the invention to provide mail container with contaminant indicator that includes a transparent window provided along a perimeter edge of the mailing container for allowing a mail recipient to verify that the mail container is free from particulate contaminates such as powders, granules, particles, etc.

Accordingly, mail container with contaminant indicator is provided. The mail container with contaminant indicator includes a mail container that includes a transparent window provided along a perimeter edge of the mailing container for allowing a mail recipient to verify that the mail container is free from particulate contaminates such as powders, granules, particles, etc.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
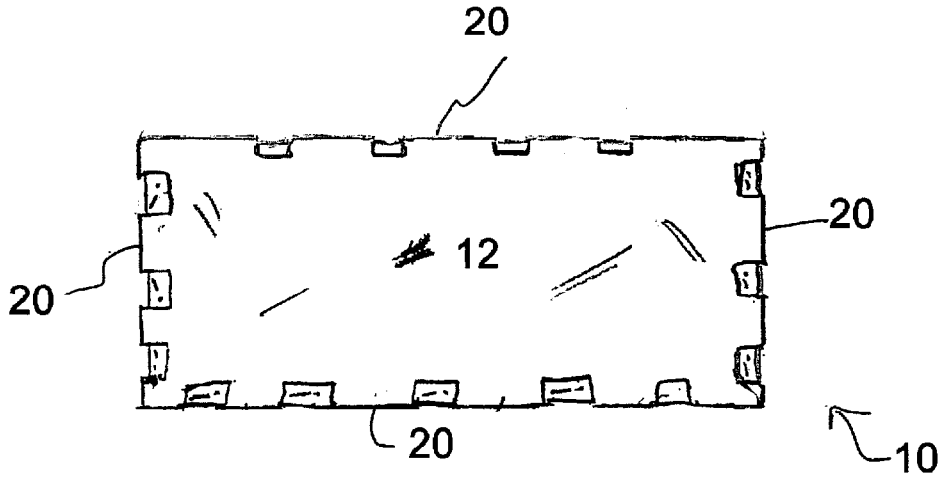
FIG. 1 is a front plan view of an exemplary embodiment of the mail container with contaminant indicator of the present invention in the form of a legal size envelope.
Figure 2:
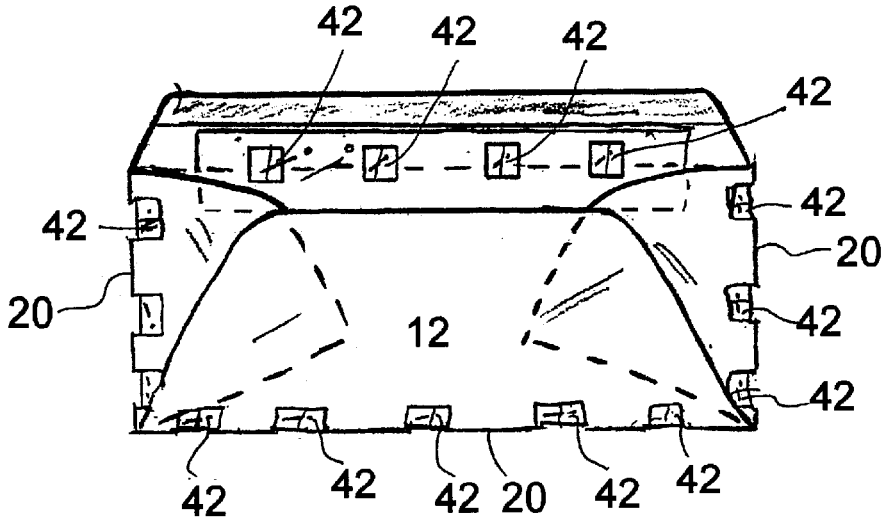
FIG. 2 is a back plan view of the mail container with contaminant indicator of FIG. 1 with the mail item insertion flap in the open position.
Figure 3:
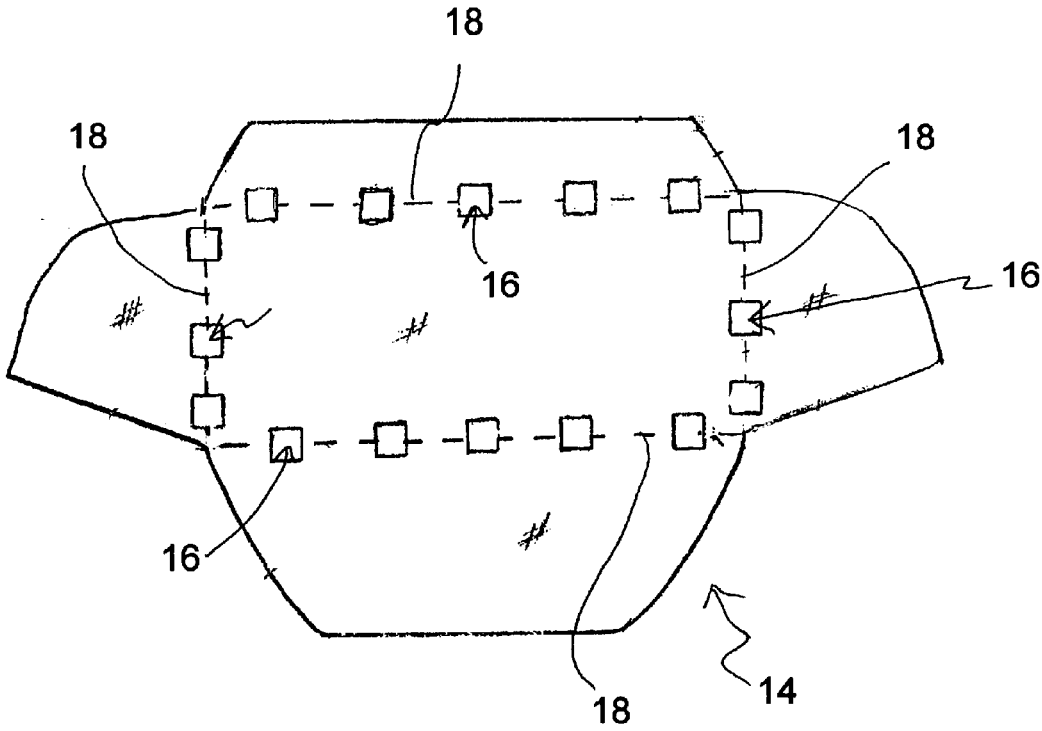
FIG. 3 is plan view of a die-cut paper blank used to form the envelope of FIGS. 1 and 2 showing the contaminant viewing holes cut out along what will form the perimeter edges of the envelope and the crease lines along which the blank is folded to from the envelope seen in FIGS. 1 and 2.
Figure 4:
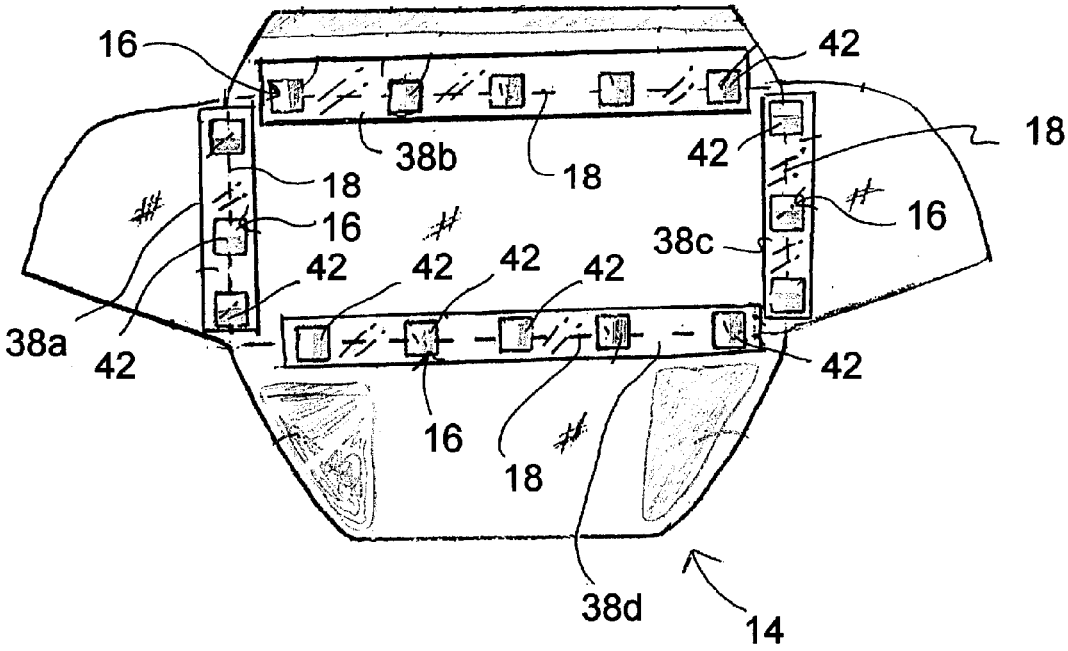
FIG. 4 is a plan view of the die-curt blank of FIG. 3 showing areas of construction adhesive, four clear plastic hole cover strips each permanently affixed to the paper blank in a manner to sealing cover a number of the contaminant viewing holes; a section of each of the cover strip covering each hole having a quantity of transparent, restickable adhesive provided thereon for trapping contaminants in particulate form, such as powders, granules, etc.

FIGS. 1–5 shows various aspects of exemplary embodiments of the mail container with contaminant indicator of the present invention generally designated 10,10*a*.

Mail container with contaminant indicator 10 is a legal sized envelope, generally designated 12, is formed from a die-cut paper blank, generally designated 14 (FIGS. 3,4) having contaminant viewing holes, generally designated 16, cut out across crease lines 18 along what will form the perimeter edges 20 of the envelope 12. Four clear plastic hole cover strips 38*a–d* are each permanently affixed to the paper blank 14 in a manner-to-sealing cover a number of the contaminant viewing holes 16 such that all the contaminant viewing holes 16 are sealed.

In this embodiment, one half of each section of plastic hole cover strip 38*a–d* covering each contaminant viewing hole 16 has an adhesive area 42 having a quantity of transparent, restickable adhesive provided thereon for trapping particulate contaminants for ready viewing by the mail container recipient. Restickable adhesive is used to prevent mail items from being damaged by adhesion to the adhesive areas 42.

Figure 5:
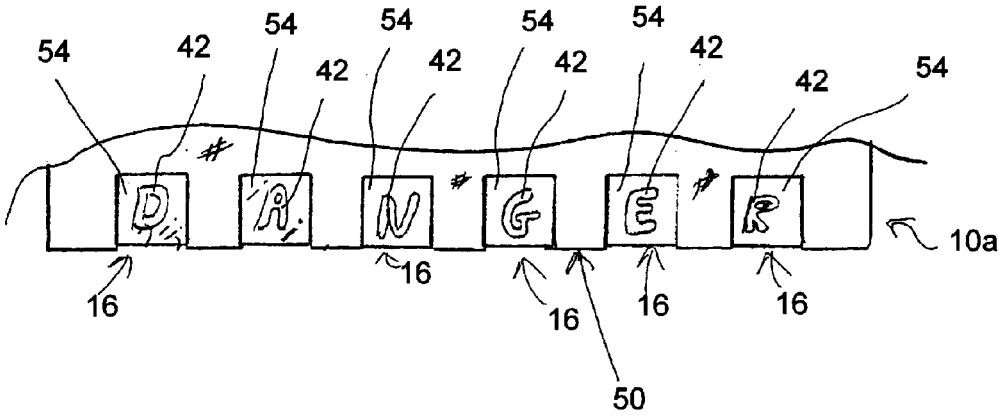
FIG. 5 is a partial plan view of a bottom edge of a second exemplary mail container with contaminant indicator of the present invention in the form of a box having a bottom edge provided with six contaminant viewing holes formed through a bottom front edge wherein the contaminant viewing holes are sealing covered with a transparent plastic cover; each transparent cover having a quantity of transparent, restickable adhesive provided thereon for trapping contaminants in particulate form, such as powders, granules etc. that are deposited onto the plastic cover in a manner to spell out the message "DANGER" to a mail recipient should particulate contaminants adhere to the adhesive areas.

FIG. 5 shows a portion of a second exemplary mail container 10*a* in the form of a box 10*a* having a forward bottom edge 50 provided with six contaminant viewing holes 16 formed through forward bottom edge 50 wherein the contaminant viewing holes 16 are sealing covered with a transparent plastic cover 54 and each transparent cover 54 has an adhesive area 42 shaped in the form of a letter having a quantity of transparent, restickable adhesive provided thereon for trapping contaminants in particulate form, such as powders, granules etc. that are deposited onto the plastic cover in a manner to spell out the message "DANGER" to a mail recipient should particulate contaminants adhere to the adhesive areas 42.

It can be seen from the preceding description that mail container with contaminant indicator has been provided.

It is noted that the embodiment of the mail container with contaminant indicator described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A mail container with containment indicator comprising:

a transparent window provided along a perimeter edge of the mailing container for allowing a mail recipient to verify that the mail container is free from particulate contaminates;

the transparent window having an area thereon covered with a transparent adhesive for adhesively trapping particulate contaminates in a readily visible location.

2. A mail container with containment indicator comprising:

a transparent window provided along a perimeter edge of the mailing container for allowing a mail recipient to verify that the mail container is free from particulate contaminate;

the transparent window having an area thereon covered with a transparent, restickable adhesive for adhesively trapping particulate contaminates in a readily visible location in a manner that does not damage items being mailed in the mailing container.

3. A mail container with containment indicator comprising:

a plurality of transparent windows provided along a perimeter edge of the mailing container for allowing a mail recipient to verify that the mail container is free from particulate contaminates;

a number of the plurality of transparent windows being adjacent to each other and each having a transparent adhesive area provided thereon; each of the transparent adhesive areas being shaped and arranged with respect to each other such that, should particulate matter be trapped on each of the transparent adhesive areas, a message is spelled out that is readily visible.

4. The mail container of claim 3 wherein:

the transparent adhesive areas are formed using transparent restickable adhesive.

* * * * *